US008599045B2

(12) United States Patent
Khatwa et al.

(10) Patent No.: US 8,599,045 B2
(45) Date of Patent: Dec. 3, 2013

(54) SYSTEMS AND METHODS FOR ENHANCED AWARENESS OF CLEARANCE FROM CONFLICT FOR SURFACE TRAFFIC OPERATIONS

(75) Inventors: Ratan Khatwa, Sammamish, WA (US); Jeff Lancaster, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 662 days.

(21) Appl. No.: 12/568,434

(22) Filed: Sep. 28, 2009

(65) Prior Publication Data

US 2011/0074607 A1 Mar. 31, 2011

(51) Int. Cl.
*G08G 5/00* (2006.01)

(52) U.S. Cl.
USPC ..... 340/947

(58) Field of Classification Search
USPC ..... 340/947, 971, 972, 945, 958, 995.13, 340/961; 701/120, 301
See application file for complete search history.

(56) References Cited

U.S. PATENT DOCUMENTS

| | | | | |
|---|---|---|---|---|
| 5,321,406 | A * | 6/1994 | Bishop et al. | 342/32 |
| 6,216,064 | B1 | 4/2001 | Johnson et al. | |
| 6,564,149 | B2 * | 5/2003 | Lai | 701/301 |
| 6,606,563 | B2 * | 8/2003 | Corcoran, III | 701/301 |
| 6,983,206 | B2 * | 1/2006 | Conner et al. | 701/301 |
| 7,006,032 | B2 | 2/2006 | King et al. | |
| 7,109,889 | B2 * | 9/2006 | He | 340/971 |
| 7,117,089 | B2 | 10/2006 | Khatwa et al. | |
| 2003/0033084 | A1 * | 2/2003 | Corcoran, III | 701/301 |
| 2004/0225440 | A1 * | 11/2004 | Khatwa et al. | 701/301 |
| 2006/0214816 | A1 * | 9/2006 | Schell | 340/961 |
| 2008/0109163 | A1 * | 5/2008 | Stone et al. | 701/211 |
| 2008/0306691 | A1 * | 12/2008 | Louis et al. | 701/301 |
| 2010/0023191 | A1 * | 1/2010 | Stefani | 701/21 |
| 2010/0324755 | A1 * | 12/2010 | Zammit-Mangion | 701/3 |

FOREIGN PATENT DOCUMENTS

WO 2005114613 A1 12/2005

OTHER PUBLICATIONS

Daryal Kuntman, Airborne system to address leading cause of injuries in non-fatal airline accidents, ICAO Journal, vol. 55, No. 2, Mar. 2000. pp. 11-12, 27.

* cited by examiner

*Primary Examiner* — Phung Nguyen
(74) *Attorney, Agent, or Firm* — Shumaker & Sieffert, P.A.

(57) ABSTRACT

Systems and methods for improving pilot situational awareness in the airport vicinity. An example method determines if at least one of an aircraft or vehicle in a predefined vicinity of the airport is a conflict based on information about an installation aircraft, information received from the at least one aircraft or vehicle, and a predefined conflict envelope, when the installation aircraft is performing one of an approach to landing, a takeoff operation or a taxi operation at an airport. The method generates and outputs a conflict alert if the installation aircraft determines that the at least one aircraft or vehicle is a conflict. The method generates a clear-of-conflict advisory if the at least one aircraft or vehicle previously determined to be conflicting is determined to no longer be conflicting based on updated information received from the at least one aircraft or vehicle.

14 Claims, 7 Drawing Sheets

SYSTEMS AND METHODS FOR ENHANCED AWARENESS OF CLEARANCE FROM CONFLICT FOR SURFACE TRAFFIC OPERATIONS

GOVERNMENT INTEREST

The invention described herein was made in the performance of work under U.S. Government Contract No. MOA#DTFAWA-09-A-00001 awarded by the Federal Aviation Administration. The Government may have rights to portions of this invention.

BACKGROUND OF THE INVENTION

There are many types of ground- or near-ground-based aviation operations that may result in a conflict between two aircraft, or between an aircraft and a ground vehicle. The key element of each conflict is that there is a potential for a mishap, defined here as when two aircraft (or an aircraft and a ground vehicle) either strike each other or narrowly avoid striking each other. There are systems in existence and under development that seek to inform or otherwise make aware to the pilot that ownship (their aircraft) may soon be or will be in conflict with another aircraft or ground vehicle via alerts (i.e., advisories, cautions, or warnings) that are either visual or aural in nature, or both (i.e., mixed-modal). These alerts may be presented on a Cockpit Display of Traffic Information (CDTI) that enhances crew awareness of surrounding traffic. The primary operational goal of each system is to support pilot situation awareness with respect to avoiding conflicts. However, once the condition that caused the alert no longer exists, the flight crew might be under the impression that the conflict condition still exists thereby utilizing valuable cognitive resources.

SUMMARY OF THE INVENTION

The present invention provides systems and methods for improving pilot situational awareness in the airport vicinity. An example method determines if at least one of an aircraft or vehicle in a predefined vicinity of the airport is a conflict based on information about an installation aircraft, information received from the at least one aircraft or vehicle, and a predefined conflict envelope, when the installation aircraft is performing one of an approach to landing, a takeoff operation or a taxi operation at an airport. The method generates and outputs a conflict alert if the installation aircraft determines that the at least one aircraft or vehicle is a conflict. The method generates a clear-of-conflict advisory if the at least one aircraft or vehicle previously determined to be conflicting is determined to no longer be conflicting based on updated information received from the at least one aircraft or vehicle.

BRIEF DESCRIPTION OF THE DRAWINGS

Preferred and alternative embodiments of the present invention are described in detail below with reference to the following drawings.

DETAILED DESCRIPTION OF THE INVENTION

Figure 1:
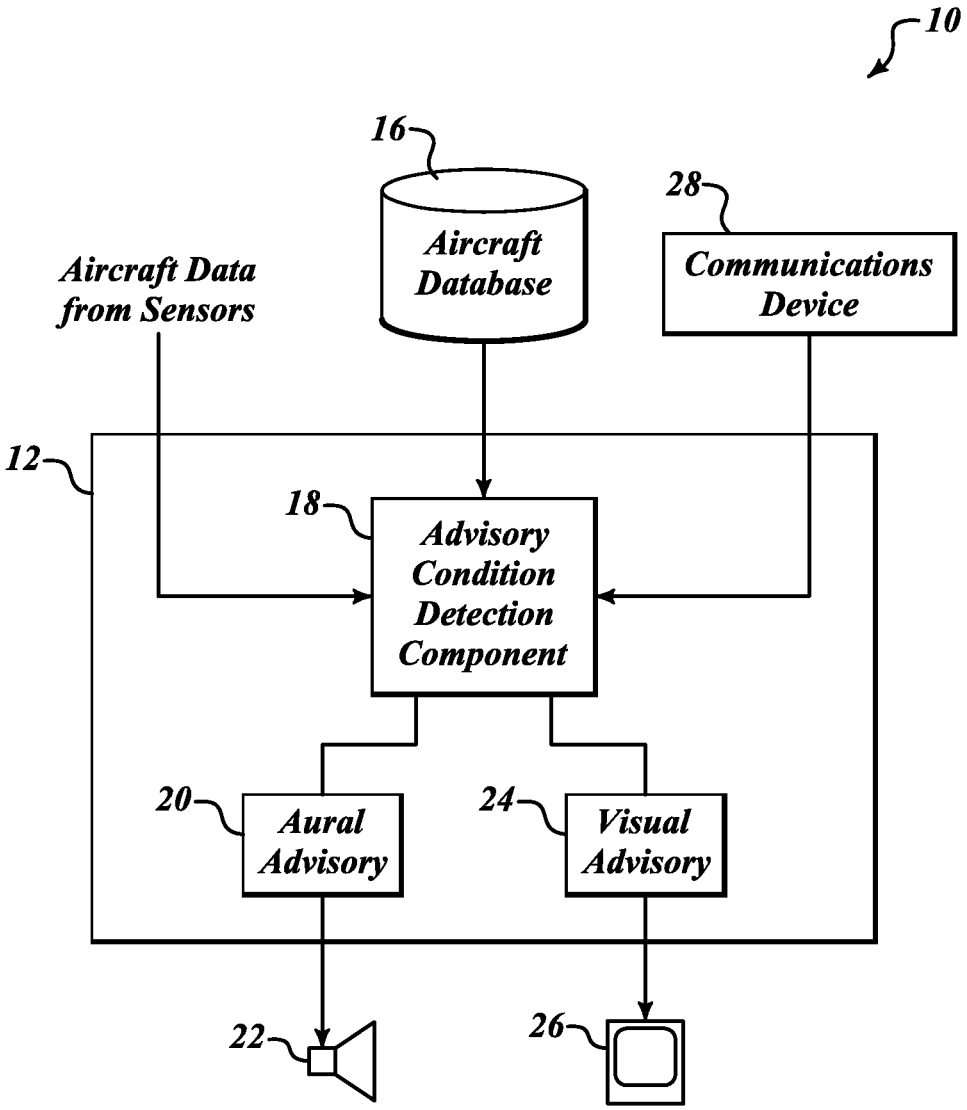
FIG. 1 is a schematic diagram of an example system formed in accordance with an embodiment of the present invention.

The present invention is an apparatus, method and computer program product for generating and annunciating to the crew of an aircraft performing a landing or ground operation an advisory indicating that a previously determined conflict with another aircraft or ground vehicle has been cleared. FIG. 1 illustrates an example aircraft 10 that includes components for locating the aircraft 10 with respect to airport taxiways and runways and generating collision and clear-of-collision advisories for enhancing pilot situational awareness.

In one embodiment, the aircraft 10 transmits the aircraft's position with respect to airport taxiways and runways, along with a heading and ground speed vector, to other similarly equipped aircraft or ground vehicles in the vicinity and receives the same information from those other similarly equipped aircraft/vehicles in order to determine if potential collision situations exist.

The aircraft 10 includes an airport situational awareness apparatus 12 that periodically samples real-time electronic data signals representative of one or more aircraft state parameters of interest, such as latitude and longitude position information; ground speed; track angle; gear setting; horizontal and vertical figures of merit; and one or more other aircraft state parameters as may be of interest. Such data is available in different formats, including ARINC Characteristic 429, ARINC Characteristic 575, analog, discrete, or an advanced digital format. The apparatus 12 accepts data in whatever format the installation aircraft 10 uses. For example, the apparatus 12 is coupled to an aircraft data bus or another suitable means for providing real-time electronic signal data source of instrument signals reporting aircraft state parameter information.

Navigation data may be obtained directly from a navigation system, which may include an inertial navigation system (INS), a satellite navigation receiver such as a global position system (GPS) receiver, VLF/OMEGA, Loran C, VOR/DME or DME/DME, or from a Flight Management System (FMS).

The apparatus 12 then extracts and validates the aircraft state parameters of interest, and using this information computes derived parameter values such as "in air" and "geometric altitude" which is a blended combination of an instantaneous GPS altitude signal and the barometric altitude signal, as described by Johnson et al. in U.S. Pat. No. 6,216,064, issued on Apr. 10, 2001, which is owned by the assignee of the present application and the entirety of which is incorporated herein by reference.

The extracted and derived aircraft state parameter values of interest are sent to an advisory condition detection processor 18. The processor 18 receives runway information as discussed herein from a searchable airport database 16 of stored airport information that includes data on fixed obstacles (towers, buildings and hangars), taxiways and runways of interest, including: airport designator for identifying airport; width and length values; positions of taxiways; runway survey data, including runway center point, runway centerline and both runway endpoints; Runway Position Quality information providing a gross estimate in nautical miles of position uncertainty of runway and Quality Factor information providing fine estimate, for example in feet, of position uncertainty of runway; a runway accuracy factor used by an aircraft locating and advising (Runway Awareness and Advisory System-RAAS) portion of the airport situational awareness; runway elevation; runway true heading in degrees for the end of runway, and runway designator angle based on assigned designation; glideslope angle in degrees for an approach on either heading, i.e., from either end of the runway; runway designator; transition altitude in feet at the runway location; and runway quality information and terrain quality data within a selected area surrounding the runway, such as an area of about 15 miles, including highest and lowest elevations; and a survey accuracy factor. These and other information of interest are present as internal signals for operation of the airport situational awareness apparatus of the invention.

The aircraft 10 also includes a communications component 28 that transmits data signals from the processor 18. The transmitted data signals include changes in the status of the installation aircraft 10. The data signals are received by other aircraft/vehicles in the vicinity. The communications component 28 receives similar transmissions directly from other equipped aircraft/vehicles and supplies the received data to the processor 18 to support advisory generation. In another embodiment, the communications component 28 receives similar transmissions indirectly via a ground-based system. Transmissions from other equipped aircraft/vehicles are performed according to ADS-B, ADS-R or similar transmission protocols. Transmissions from the ground-based system are performed according to Traffic Information Service-Broadcast (TIS-B), Flight Information Services-Broadcast (FIS-B) or comparable protocols.

Upon receipt of the other aircraft/vehicle position information and motion vectors, the processor 18 determines potential conflicts and annunciates the potential conflicts. Optionally, one or more of the other aircraft/vehicles are depicted on a display 26 of the airport and environs at least for aircraft/vehicles having a position and motion vector that creates a potential conflict with the aircraft 10.

When the processor 18 determines a conflict exists with another aircraft/vehicle in the airport environment, the processor 18 generates output signals that stimulate an aural advisory component 20. Then, the aural advisory component 20 generates an aural advisory signal and outputs the generated aural advisory signal to an audio device 22 such as a cockpit speaker, headset or equivalent cockpit audio system.

In another embodiment, when a conflict exists a visual advisory component 24 receives the outputted signal(s) from the processor 18, then generates video output signals to the display 26 that result in display either or both of textual and pictographic information indicative of status and advisories.

The present invention provides the crew with either or both of the aural and visual annunciations of information indicating as appropriate that: a runway (or other airport surface) being approached or entered is occupied by another vehicle or other airport equipment; a runway (or other airport surface) being approached or entered is being vacated by another vehicle; and another vehicle is approaching or entering a runway (or other airport surface) currently occupied by the installation aircraft 10.

After a conflict has been determined, the processor 18 determines if the aircraft 10 is clear from the previously identified conflict (conflicting aircraft/vehicle is now outside of an alerting envelope). If the aircraft 10 is determined to be clear, a 'clear of conflict' message (visually, aurally, or mixed-modal) is presented to the operator. The alerting envelope is a function of proximity to target (altitude and lateral distance), heading of ownship and target, relative speed between ownship and target, and/or time-to-collision. Once the target is no longer within the alerting envelope, a clear-of-conflict alert is generated. This has the potential to free-up the operator's mental resources that had been used to monitor the potential conflict to be focused instead on routine operations (e.g., continuing on a taxiway, taxi into position and hold (TIPH), landing).

According to one embodiment of the invention, the aircraft 10 periodically broadcasts the up-to-date aircraft position and velocity vector information and changes its status to other aircraft in the vicinity by RF broadcast via the communications component 28, and periodically receives such broadcasts from other installation aircraft in the vicinity using a short range, low power local band that limits the range of the broadcast to the airport and its immediate environs. Ground-based repeaters are optionally employed in area of severe signal attenuation such as areas shielded by terrain or by fixed obstacles such as hangars. This broadcast of aircraft position and velocity vector information is conceptually similar to existing RF communication functions such as Mode S transponder, or the evolving Automatic Dependent Surveillance (ADS, or "ADS-B") concepts including universal access transceiver ("UAT"). Existing ADS data could be used to augment some parts of the broadcast of the current invention, but is insufficient to solve the problem at least because these other existing RF communication systems are disabled on the ground to reduce or limit frequency congestion which precludes relying on the data for on-ground runway conflict detection. These other existing RF communication systems (with the exclusion of UAT) are relatively expensive, which in practice excludes their application to small aircraft, trucks, and fixed obstacles, which are many times at the root of real-world accidents that the present invention addresses. These other existing RF communication systems fail to incorporate at least some of the flag bits, e.g., OnRwy, Crossing, and M/T flag, used to enable the advisories. These other existing RF communication systems by design utilize a relatively high-power broadcast. Even if all these identified problems were addressed, the resulting larger RF communication system for practicing the invention would fail at busy airports because of frequency congestion. Reducing the transmit power would make them useless to their existing purposes.

The present invention may be used in conjunction with a Runway Traffic Awareness and Advisory System (RTAS), such as that being developed by Honeywell, Inc.®, provides traffic advisories of other aircraft that are either occupying a runway or approaching a runway. The system uses data from multiple systems including:

TCAS;

Automatic Dependent Surveillance-Broadcast (ADS-B); and

Enhanced Ground Proximity Warning System (EGPWS) terrain and runway database functions. An example RTAS is described in co-owned U.S. Pat. No. 7,117,089 issued Oct. 3, 2006, the contents of which are hereby incorporated by reference.

Also, the present invention may be used in conjunction with a Taxi Awareness and Advisory System (TAAS), such as that being developed by Honeywell, Inc.®, see U.S. Pat. No. 7,109,889 issued Sep. 19, 2006, the contents of which are hereby incorporated by reference. The TAAS provides a moving map display for airport surface operations, including taxiways. The TAAS database requires information on all elements that are displayed (e.g., runways, taxiways, ramp areas, de-icing areas). It is currently being developed to include the display of traffic targets. An example RTAS is described in co-owned U.S. Pat. No. 7,109,889 issued Sep. 19, 2006, the contents of which are hereby incorporated by reference. The present invention may include other system concepts, such as the Enhanced Traffic Situation Awareness on the Airport Surface with Indications & Alerts (ATSA SURF IA), utilize ADS-B and other technologies with which to monitor aircraft and ground vehicles.

These technologies can coordinate to produce and present indications and/or alerts (i.e., visual, aural, or mixed-modal) to operators when there is the possibility and/or likelihood of a conflict.

Figure 2:
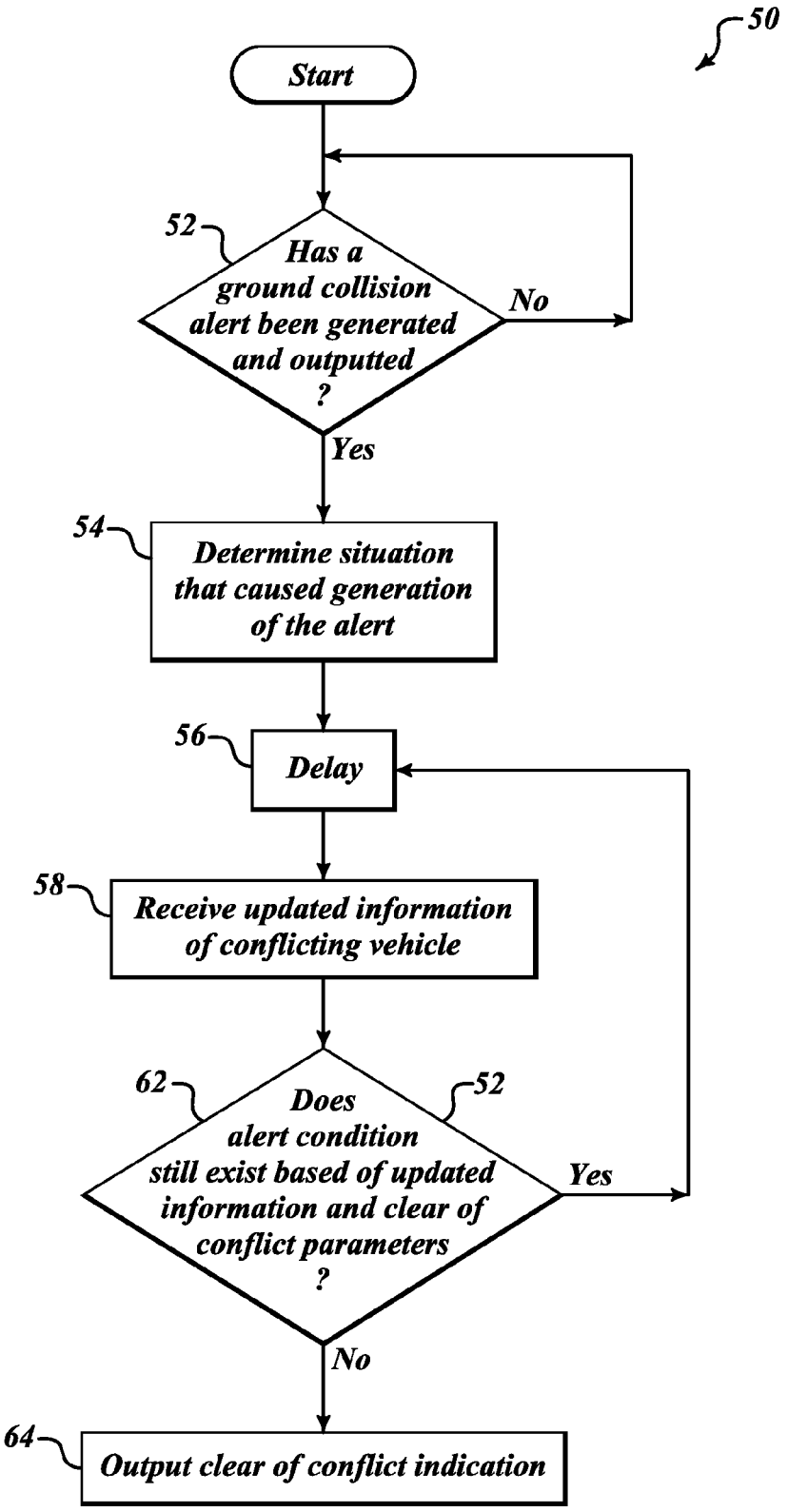
FIG. 2 is a flowchart of an example process executed by the system shown in FIG. 1.

FIG. 2 illustrates a flowchart of an example process 50 performed by the processor 18. First at a decision block 52, the processor 18 determines if a ground collision alert has been generated and outputted. If no ground collision alert was generated, then the process 50 is in a hold mode. If ground collision alert was generated, then at a block 54, the processor 18 determines the situation that caused generation of the alert. This is performed so that the processor 18 knows what alerting envelope to analyze. This could be an inherent step if that information is recorded at the time an alert is generated. A delay occurs at a block 56. At a block 58, updated information of the conflicting vehicle is received. At a decision block 62, the processor 18 determines if the alert condition still exists based on the updated information and clear-of-conflict parameters (determined situation, i.e., alerting envelope). The present condition of the installation aircraft may optionally be considered when determining if the alert condition still exists. If the alert condition still exists, the process 50 returns to the delay at block 56. If the alert condition does not exist, the processor 18 outputs an aural or visual clear-of-conflict indication (see block 64).

Figures 1, 3:
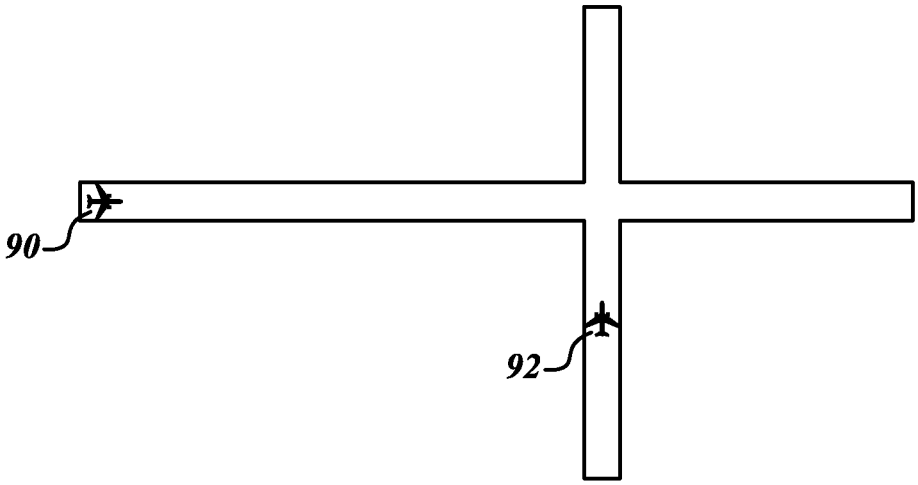
FIGS. 3-7 illustrate top views of airport environments with aircraft in conflict and nonconflict situations.
Figures 2, 3:
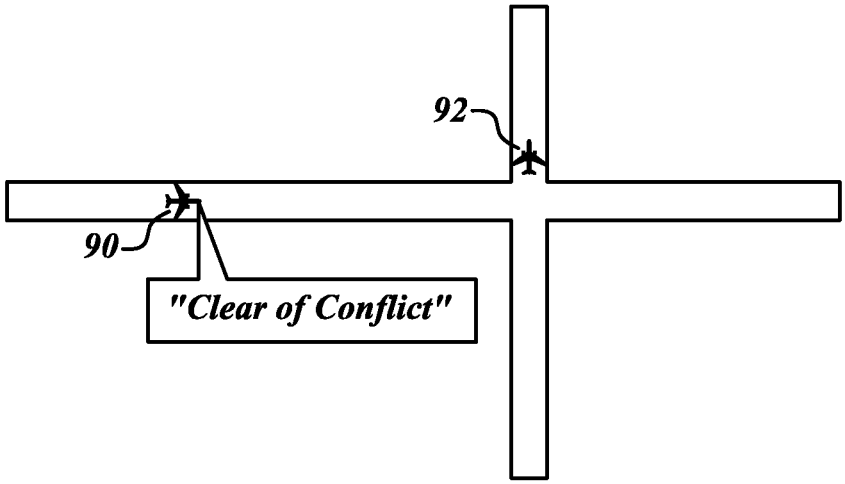

FIG. 3-1 is an overhead view of night time or bad weather operation at an airport. An ownship 90 is about ready to takeoff and has TIPH, taking off or is taxiing on the runway. Another aircraft 92 is starting takeoff roll for a mid-field intersection runway. The ownship 90 processes signals from the other aircraft 92 and presents a traffic moving on a display with the intersecting runway highlighted (e.g., yellow outline). The ownship 90 may produce an aural alert as well as further informing the flight crew of the ownship 90 that a conflict exists. As shown in FIG. 3-2, the conflict aircraft 92 becomes airborne, thus clearing the runway intersection. The ownship 90 receives the information that the conflict aircraft 92 has become airborne and is clear of the runway intersection. The ownship 90 determines the conflicting situation no longer exists and removes the highlight of the intersecting runway and outputs a "Clear-of-conflict" advisory via audio and/or video.

Figures 1, 4:
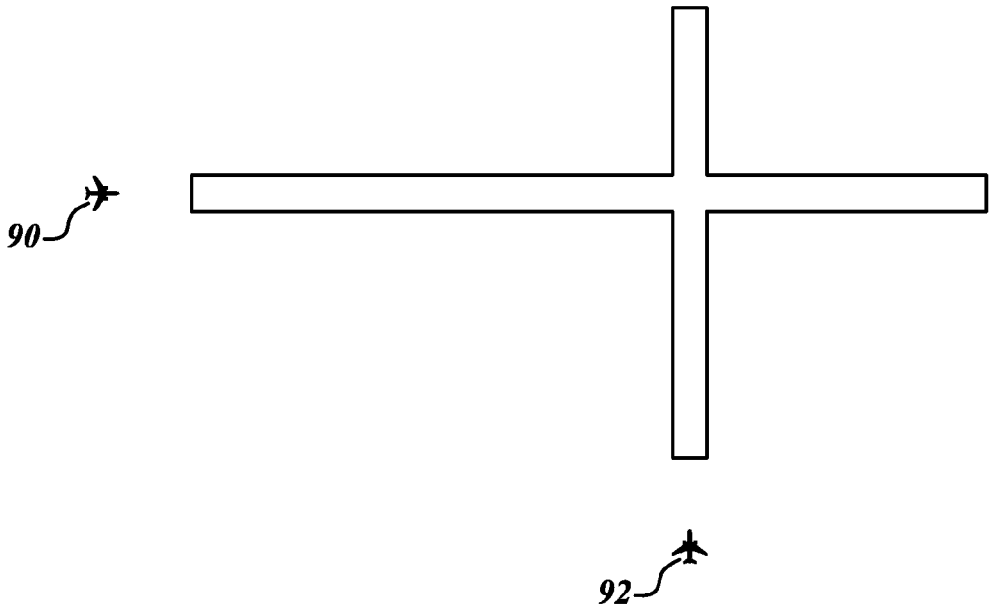
Figures 2, 4:
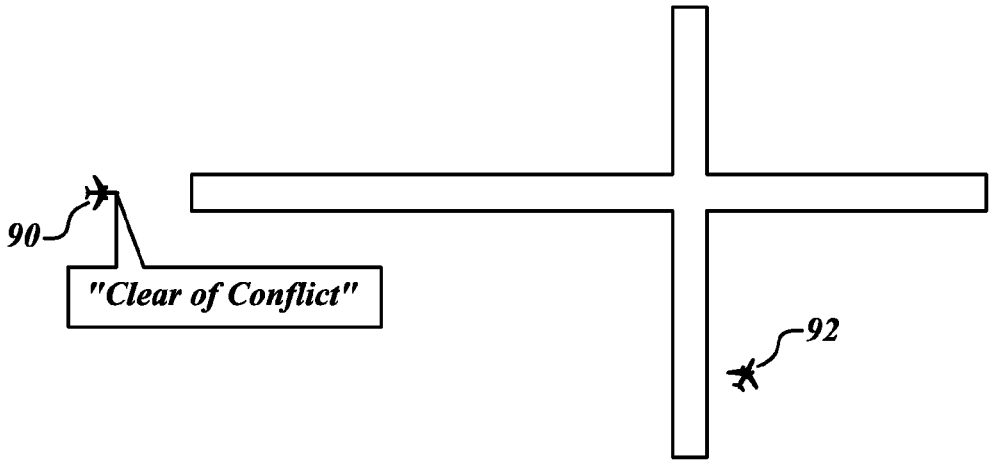

FIG. 4-1 shows another airport environment conflicting aircraft situation. Two aircraft (the ownship 90 and the target/conflict aircraft 92) are on final approach to intersecting runways in low visibility. A display on the ownship 90 presents an ATSA SURF-type indication (e.g., yellow outlines) for the runway that the target/conflict aircraft 92 is approaching.

As shown FIG. 4-2, the target/conflict aircraft 92 initiates a go-around (increases airspeed, climbs, turns). The go-around information is sent to the ownship 90. The ownship 90 determines that the conflict situation no longer exists and the runway indication goes away and a "Clear-of-conflict" advisory is outputted as described above.

Figures 1, 5:
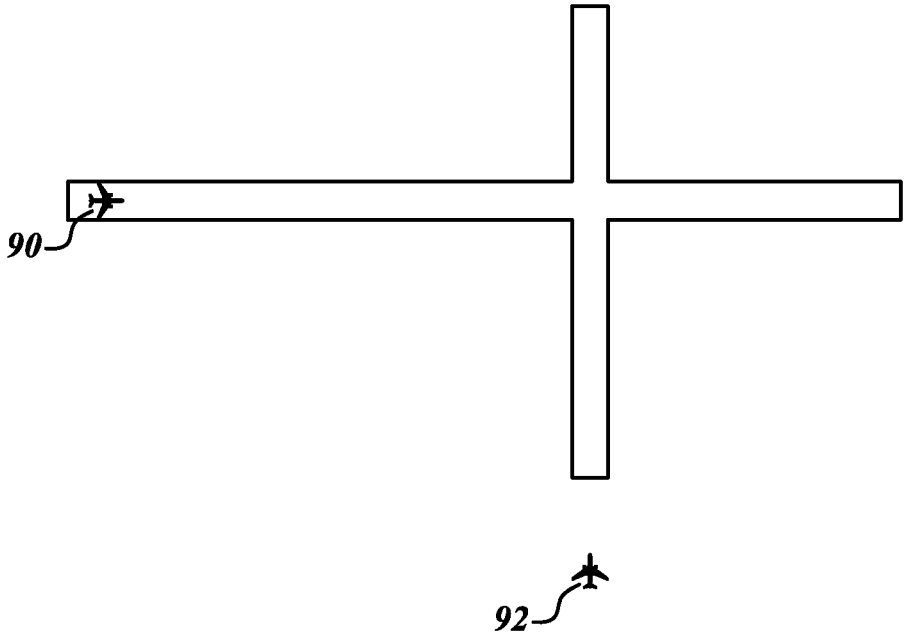
Figures 2, 5:
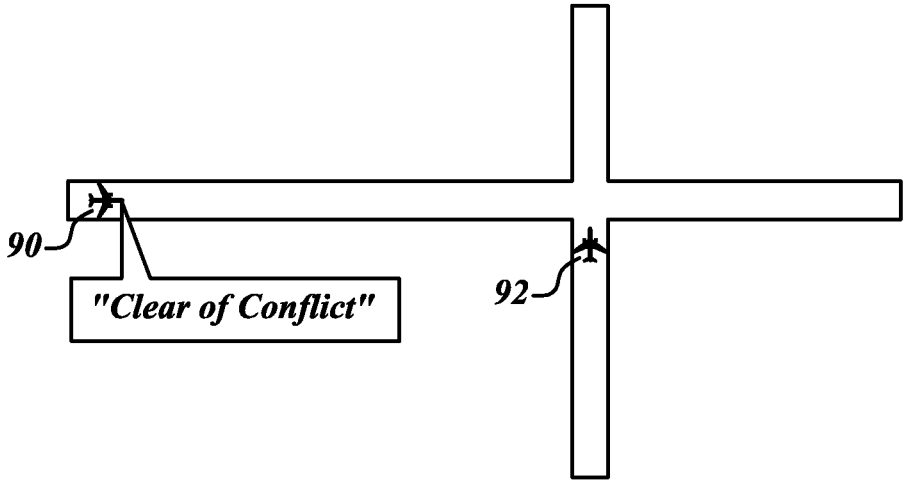

As shown FIG. 5-1, the ownship 90 is taking off or taxiing. The conflict aircraft 92 is about to conduct Land and Hold Short (LAHSO) operation on an intersecting runway. The conflict aircraft 92 lands slightly long. The ownship 90 generates and outputs a "Caution, conflict" alert or similar. FIG. 5-2, the conflict aircraft 92 completes a safe LAHSO operation, stopping short of the ownship runway. The ownship 90 outputs a "Clear-of-conflict" message after receiving updated position and motion information from the conflict aircraft 92.

Figures 1, 6:
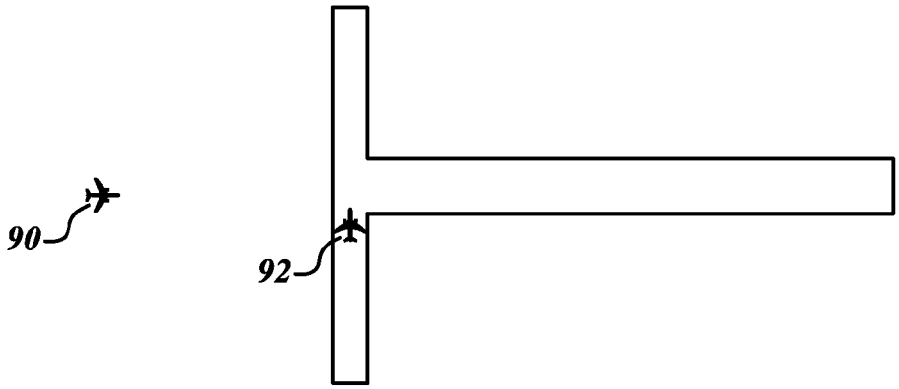
Figures 2, 6:
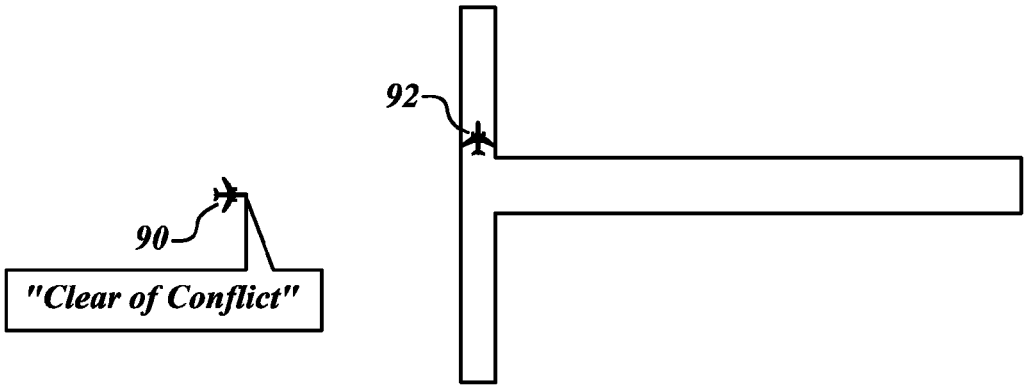

As shown in FIG. 6-1, the ownship 90 is on final approach to landing and the conflict aircraft 92 is inadvertently crossing an intersecting taxiway hold line. The ownship 90 generates a "Warning, conflict" or similar message based on the position and motion information received from the conflict aircraft 92. FIG. 6-2 shows that the conflict aircraft 92 has crossed to the taxiway on the other side of the runway, thus clearing the runway. Based on updated position and motion information received from the conflict aircraft 92, the ownship 90 generates and outputs a "Clear-of-conflict" advisory.

Figures 1, 7:
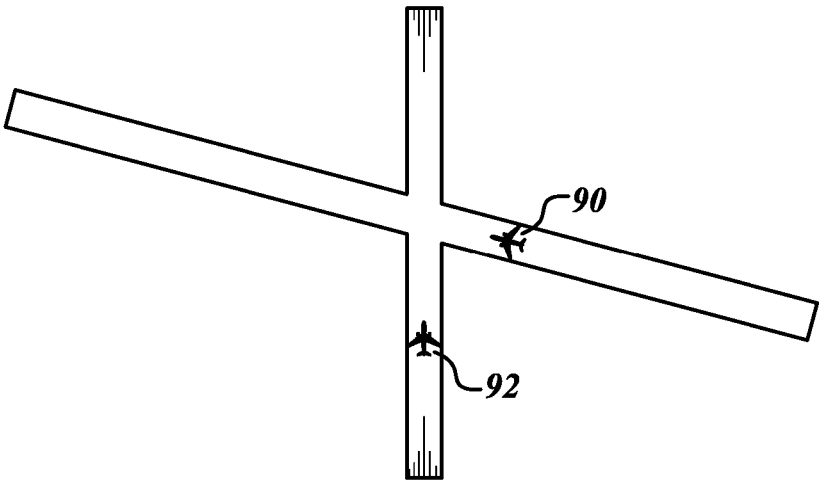
Figures 2, 7:
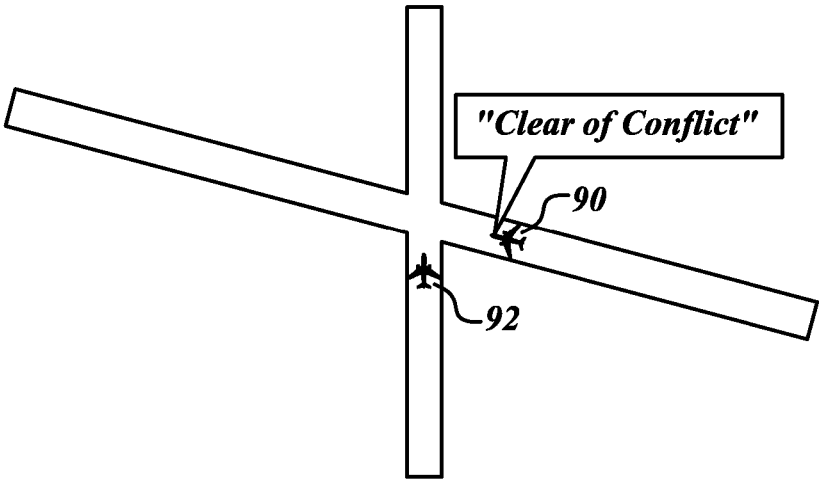

As shown in FIG. 7-1, the ownship 90 and conflict aircraft 92 are on intersecting taxiways approaching an intersection during low visibility taxi operations. The ownship 90 generates a "Warning, conflict" or similar message and/or display indication. FIG. 7-2 shows that the conflict aircraft 92 stops on its taxiway, thus no longer making it a conflict with the ownship 90. Based on updated position and motion information received from the conflict aircraft 92, the ownship 90 generates a "Clear-of-conflict" advisory.

While the preferred embodiment of the invention has been illustrated and described, as noted above, many changes can be made without departing from the spirit and scope of the invention. For example, the "Clear-of-conflict" advisory may include more specific information that relates to the no longer conflicting aircraft/vehicle, such as present location or action. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A method comprising:

at an installation aircraft performing one of an approach to landing, go-around, a takeoff operation or a taxi operation at an airport, a) determining if at least one of an aircraft or vehicle in a predefined vicinity of the airport is a conflict based on information about the installation aircraft, information received from the at least one aircraft or vehicle, and a predefined conflict envelope;

b) generating and outputting a conflict alert if the installation aircraft determines that the at least one aircraft or vehicle is a conflict;

c) repeating a) after a predefined delay;

d) generating a clear-of-conflict advisory if the at least one aircraft or vehicle previously determined to be conflicting is determined to no longer be conflicting based on updated information received from the at least one aircraft or vehicle, and outputting the clear-of-conflict advisory, and e) periodically transmitting at least one of position and motion information from the installation aircraft, wherein the periodic transmission is performed at a power level capable of reaching environs of the airport.

2. The method of claim 1, wherein outputting the conflict alert comprises at least one of visually or audibly outputting the conflict alert.

3. The method of claim 2, wherein outputting the clear-of-conflict advisory comprises at least one of visually or audibly outputting the clear-of-conflict advisory.

4. The method of claim 3, wherein outputting the clear-of-conflict advisory comprises outputting a prerecorded audio message over one or more speakers.

5. The method of claim 1, wherein the predefined conflict envelope is based on the operation the installation aircraft is performing.

6. A system on an installation aircraft, the system comprising:

a means for determining if at least one of an aircraft or vehicle in a predefined vicinity of an airport is a conflict based on information about the installation aircraft, information received from the at least one aircraft or vehicle, and a predefined conflict envelope, when the installation aircraft is performing one of an approach to landing, go-around, a takeoff operation or a taxi operation at the airport;

a means for generating and outputting a conflict alert if the installation aircraft determines that the at least one aircraft or vehicle is a conflict;

a means for delaying after outputting of the conflict alert;

a means for receiving updated information from the at least one aircraft or vehicle;

a means for generating a clear-of-conflict advisory if the at least one aircraft or vehicle previously determined to be conflicting is determined to no longer be conflicting based on the received updated information; and a means for outputting the clear-of-conflict advisory, and a means for periodically transmitting at least one of position and motion information from the installation aircraft, wherein the periodic transmission is performed at a power level capable of reaching environs of the airport.

7. The system of claim 6, wherein the means for outputting the conflict alert outputs the conflict alert at least one of visually or audibly.

8. The system of claim 6, wherein the means for outputting the clear-of-conflict advisory outputs the clear-of-conflict advisory at least one of visually or audibly.

9. The system of claim 8, wherein the means for outputting clear-of-conflict advisory outputs a prerecorded audio message over one or more speakers.

10. The system of claim 6, wherein the predefined conflict envelope is based on the operation the installation aircraft is performing.

11. An aircraft comprising:

a communication component;

a database configured to store airport information;

a plurality of sensors;

at least one output device; and a processor in signal communication with the communication component, the database, the plurality of sensors and the at least one output device, the processor configured to:

determine if the aircraft is performing one of an approach to landing, go-around, a takeoff operation or a taxi operation at an airport based upon information received from the plurality of sensors;

if the aircraft is determined to be performing one of an approach to landing, go-around, a takeoff operation or a taxi operation, determine if at least one of an aircraft or vehicle in a predefined vicinity of the airport is a conflict based on information received from the plurality of sensors, information received from the at least one aircraft or vehicle via the communication component, a predefined conflict envelope and stored airport information, generate a conflict alert if the aircraft determines that the at least one aircraft or vehicle is a conflict, send the generated conflict alert to the at least one output device, delay after outputting of the conflict alert, receive updated information from the at least one aircraft or vehicle via the communication component, generate a clear-of-conflict advisory if the at least one aircraft or vehicle previously determined to be conflicting is determined to no longer be conflicting based on the updated information, and send the generated clear-of-conflict advisory to the at least one output device, and periodically transmit at least one of position and motion information via the communication component, wherein the periodic transmission is performed at a power level determined according to the stored airport information.

12. The aircraft of claim 11, wherein the at least one output device comprises a visual display.

13. The aircraft of claim 11, wherein the at least one output device comprises a loudspeaker.

14. The aircraft of claim 9, wherein the predefined conflict envelope is based on the operation the aircraft is performing.

* * * * *